US006419217B1

(12) United States Patent
Hartmann et al.

(10) Patent No.: US 6,419,217 B1
(45) Date of Patent: Jul. 16, 2002

(54) DRAWINGS-IN- OF PAPER WEBS

(75) Inventors: Manfred Wolfgang Hartmann, Elfershausen; Horst Bernhard Michalik, Höchberg, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/424,861

(22) PCT Filed: Jun. 8, 1998

(86) PCT No.: PCT/DE98/01557

§ 371 (c)(1),
(2), (4) Date: Dec. 6, 1999

(87) PCT Pub. No.: WO98/55313

PCT Pub. Date: Dec. 10, 1998

(30) Foreign Application Priority Data

Jun. 6, 1997 (DE) ..... 197 23 749

(51) Int. Cl.[7] ..... B42B 2/00

(52) U.S. Cl. ..... 270/52.12; 270/52.07; 270/52.11; 83/27; 83/102; 83/152; 198/369.2; 198/438; 225/2; 225/96; 225/98; 225/100; 225/106; 226/91; 226/95; 226/110; 226/170; 406/1; 406/78; 271/194

(58) Field of Search ..... 225/96, 96.5, 99, 225/98, 100, 106, 2, 4, 5; 83/300, 301, 303, 27, 37, 102, 107, 152; 101/224, 226, 227; 270/52.09, 52.08, 52.07, 52.12; 271/194, 300, 279; 406/1–9, 78; 198/438, 369.2, 369.5; 226/91, 95, 170, 110

(56) References Cited

U.S. PATENT DOCUMENTS 3,707,945 A * 1/1973 Boone ..... 118/234
3,843,253 A * 10/1974 Mikan et al. ..... 355/29
4,173,313 A * 11/1979 Rogers ..... 242/56.2
4,500,770 A * 2/1985 Vock et al. ..... 219/121
4,692,215 A * 9/1987 Kerttula ..... 162/289
4,909,648 A * 3/1990 Hartman et al. ..... 400/219.1
4,930,383 A 6/1990 Köbler
5,088,975 A 2/1992 Ghilardi
5,133,235 A * 7/1992 De Vito ..... 83/347
5,279,195 A 1/1994 Breton
5,451,037 A * 9/1995 Lundstrom ..... 101/228
5,596,917 A * 1/1997 Gerber et al. ..... 83/152
5,605,267 A * 2/1997 Whitten ..... 226/91
5,681,035 A * 10/1997 Ifkovits et al. ..... 270/51
5,685,528 A 11/1997 Weis (List continued on next page.)

FOREIGN PATENT DOCUMENTS

| | | |
|---|---|---|
| DE | 466928 | 11/1926 |
| DE | 1257516 | 4/1963 |
| DE | 2143932 | 9/1971 |
| DE | CH 572856 | 1/1976 |
| DE | 2532168 C3 | 10/1981 |
| DE | 4439615 A1 | 5/1996 |
| EP | 01782725 A1 | 10/1985 |
| EP | 0297282 A1 | 5/1988 |
| EP | 0479385 A1 | 10/1991 |
| EP | 0728693 A2 | 1/1996 |
| JP | 61-152400 | 7/1986 |
| JP | 1-011795 | 6/1988 |
| JP | 3-114739 | 12/1990 |
| JP | 9-105024 | 4/1997 |

*Primary Examiner*—Christopher P. Ellis
*Assistant Examiner*—Jeffery A Shapiro
(74) *Attorney, Agent, or Firm*—Jones, Tullar & Cooper, P.C.

(57) ABSTRACT

A paper web is drawn into a printing and can be guided along a selected one of several paths. The paper web is weakened along a line of separation and is then held by a retaining system that can move the web in a conveying direction along a first path. The web is fed to a different conveying path and is separated ot torn along the line of separation. This line of separation or weakening is formed at an angle to the production direction.

18 Claims, 3 Drawing Sheets

U.S. PATENT DOCUMENTS 5,697,880 A * 12/1997 Auerbach ..... 198/369.2
5,742,981 A 4/1998 Fehrer
5,785,224 A * 7/1998 Nowakowski ..... 225/100
5,879,515 A * 3/1999 Straub et al. ..... 162/275
5,897,114 A * 4/1999 Arikawa et al. ..... 271/272
6,022,452 A * 2/2000 Caspar ..... 162/286
6,206,262 B1 * 3/2001 Achelpohl et al. ..... 225/100
6,213,424 B1 * 4/2001 Helfer-Grand ..... 242/564.1

* cited by examiner

DRAWINGS-IN- OF PAPER WEBS

FIELD OF THE INVENTION

The present invention relates to a method and to a device for drawing in a paper web, as well as to a corresponding device.

DESCRIPTION OF THE PRIOR ART

It is known, from DE 25 32 168 C3, to draw in webs of material to be printed, for example paper webs, from a roll support to a folding apparatus of a web-fed rotary printing press by means of web draw-in devices. It is also possible to select different movement tracks for the webs of material to be printed.

U.S. Pat. No. 5,279,195 A describes a device for separating a defective section of a web. In the process, the web is cut, the fresh start of this web is guided to another web guide and this start is again cut off the web. The now fresh start is again guided to the original web guide.

EP 0 479 385 A1 discloses a device for cutting perforated sheets. Here, two pairs of rollers are arranged, between which the sheets are conveyed at different conveying speeds.

EP 0 297 282 A1 shows a device for dividing a flow of printed pieces. In this case, a web is cut into signatures by means of two eccentrically seated cutting cylinders and is alternatingly guided onto two tracks.

DE 196 26 014 A1 describes a device, having an air-permeable conveyor belt, for cutting a fleece into longitudinal sections. Here, a part of the fleece is held in place by means of suction air, and the other part is moved on in the conveying direction.

SUMMARY OF THE INVENTION

The object of the present invention is based on providing a method for guiding a paper web, as well as an associated device.

In accordance with the present invention, this object is attained by creating a fresh or new start on a paper web in a direction transverse to the web travel direction. The web is separated at this new start and the path of travel of the web subsequent to this new start can be changed to a second, different web travel path.

The advantages to be obtained by the present invention consist, in particular, in selectively rerouting one of a number of moving paper webs, or one or several partial paper webs, independently of each other onto predeterminable movement tracks, without it being required to stop the press, or the system, or for the operators to rehang the webs or the partial webs. In connection with a web-fed rotary printing press, for example, it might be possible to make a movement track change of a web, or of a partial web, while production is running.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
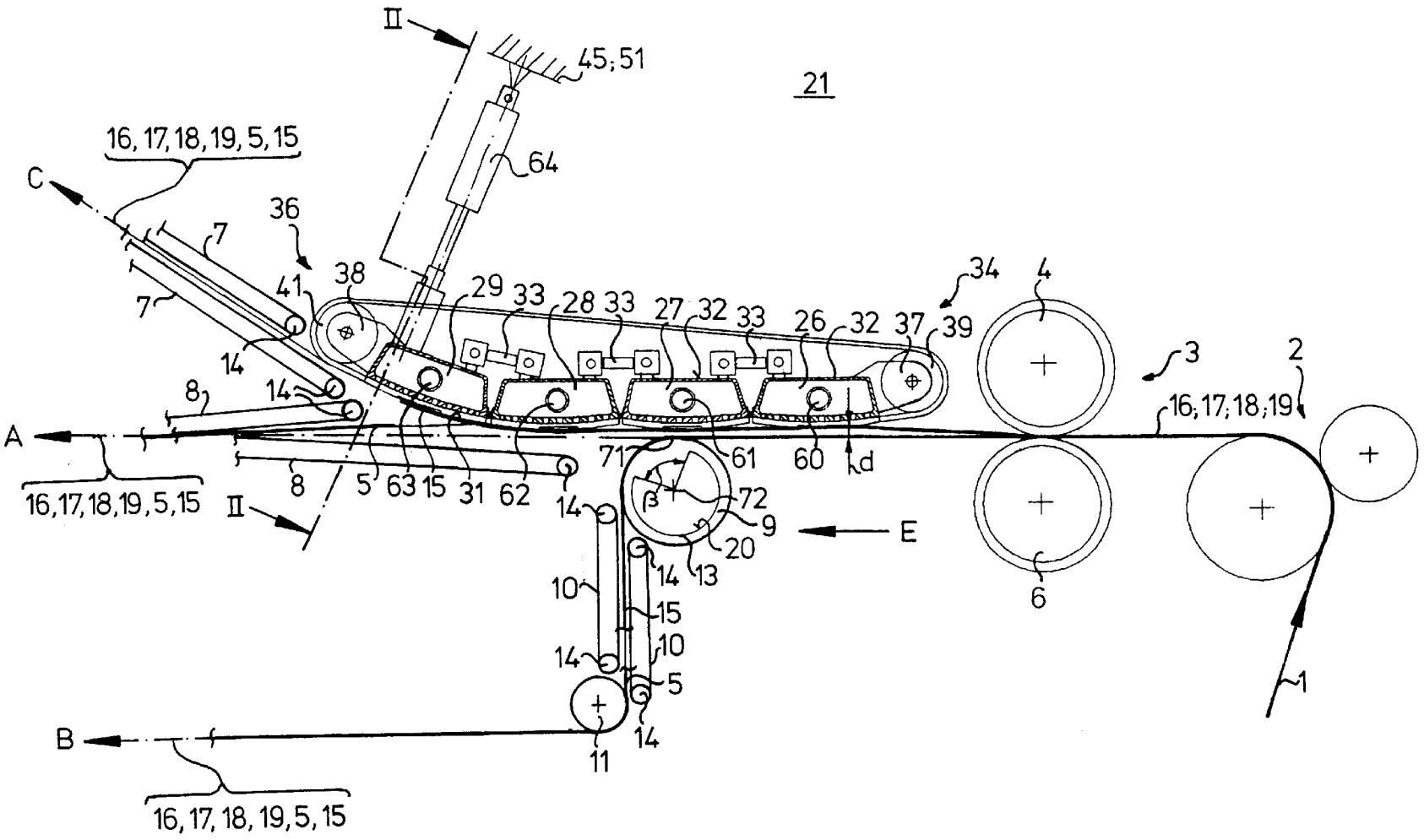
FIG. 1, a schematic representation of a side view of a device for directing a path of web or partial web travel in accordance with the present invention, FIG. 2, a section taken along line II—II of FIG. 1 and in an enlarged representation, and in FIG. 3, a view from above in accordance with FIG. 1, but without the conveyor belts.

A device 3 for reducing the tear resistance of a paper web 1 moving in the production direction E of the web is provided, as seen in FIG. 1. This device 3 can consist, for example, of a transverse perforation device, or also of another similar device, for example a device, such as a plurality of nozzles for applying a liquid track of a solvent or water transversely over the width of the web 1, or respectively over the widths of partial webs 16, 17, 18, 19 to be processed. Viewed in the production direction E of the web, the web tear resistance reducing device 3 can be arranged ahead of, or behind a longitudinal separating device 2, known per se, of the moving paper web 1.

The transverse tear resistance reducing device 3 can consist of forming rollers 4 and of bottom rollers 6, which can be placed against each other. The paper web 1 in a first movement track A, can be rerouted out of the movement track A, or into a further movement track, for example the movement track B, or into a further movement track C. For example, the movement track A may extend essentially horizontally between two first forwarding systems 8, 8. The movement track B may extend underneath the movement track A, wherein the paper web 1 is rerouted over two paper guide rollers 9, 11. The movement track C may extend above the movement track A between two second forwarding systems 7, 7.

The first and second forwarding systems 7, 8 are each devices for grasping and temporarily forwarding a part of the paper web 1, or the partial paper webs 16, 17, 18, 19. They can be, for example, so-called driven suction belts, suction rollers, or electrostatic belt devices. A plurality of deflection rollers 14 can be provided for rerouting.

Figure 3:
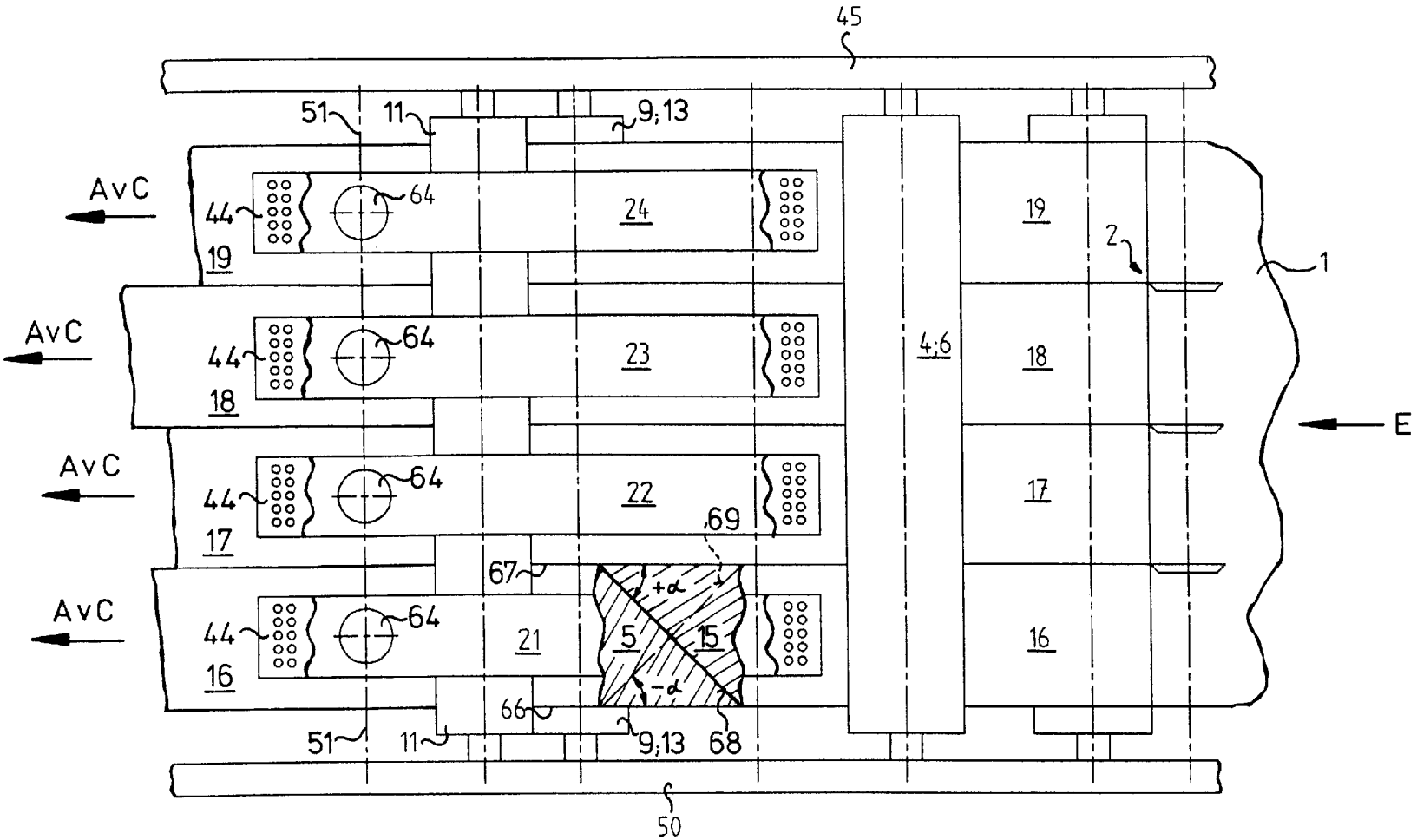

The paper web 1 can also be longitudinally cut into several partial paper webs 16, 17, 18, 19. A longitudinal cutting device 2, or a plurality of longitudinal cutting devices 2, as seen in FIG. 3, and which are known per se, can be used for this purpose.

Viewed in the production direction E of the paper web 1, a device 13, or devices 21 to 24 for grasping a start of a web 1 of material, or starts of partial webs of material 16 to 19, respectively, at their upper and/or undersides and for their subsequent rerouting into a second movement track, for example B or C, and back, are provided in the first movement track A, after the device for reducing the tear resistance of the web 1, or the partial webs 16, 17, 18, 19, and before the forwarding systems 7, 8. For example, this rerouting device can be used for rerouting webs from movement tracks A+C only into the movement track A, or from the movement tracks A+B back toward the movement track A, or from the movement tracks A+B toward the movement track A+C, etc. In this phase, the web, or a partial web, is clamped under tensile stress between two spaced-apart devices. For example, this can occur between two pairs of drawing rollers, between one pair of drawing rollers and cylinders (for example rubber blanket cylinders) of a print unit, or between cylinders of two spaced-apart print units. The web 1, or the partial webs 16 to 19, are therefore clamped between two such spaced-apart devices, while a web tension is maintained, and they are pulled apart or separated.

It is accordingly to select the number of partial webs per movement track (A, B, C), and therefore the composition and number of pages of the signatures, in a particularly simple manner. This is, of course, dependant on the occupation of the print units. Web transfers, known per se, are required for this.

Figure 2:
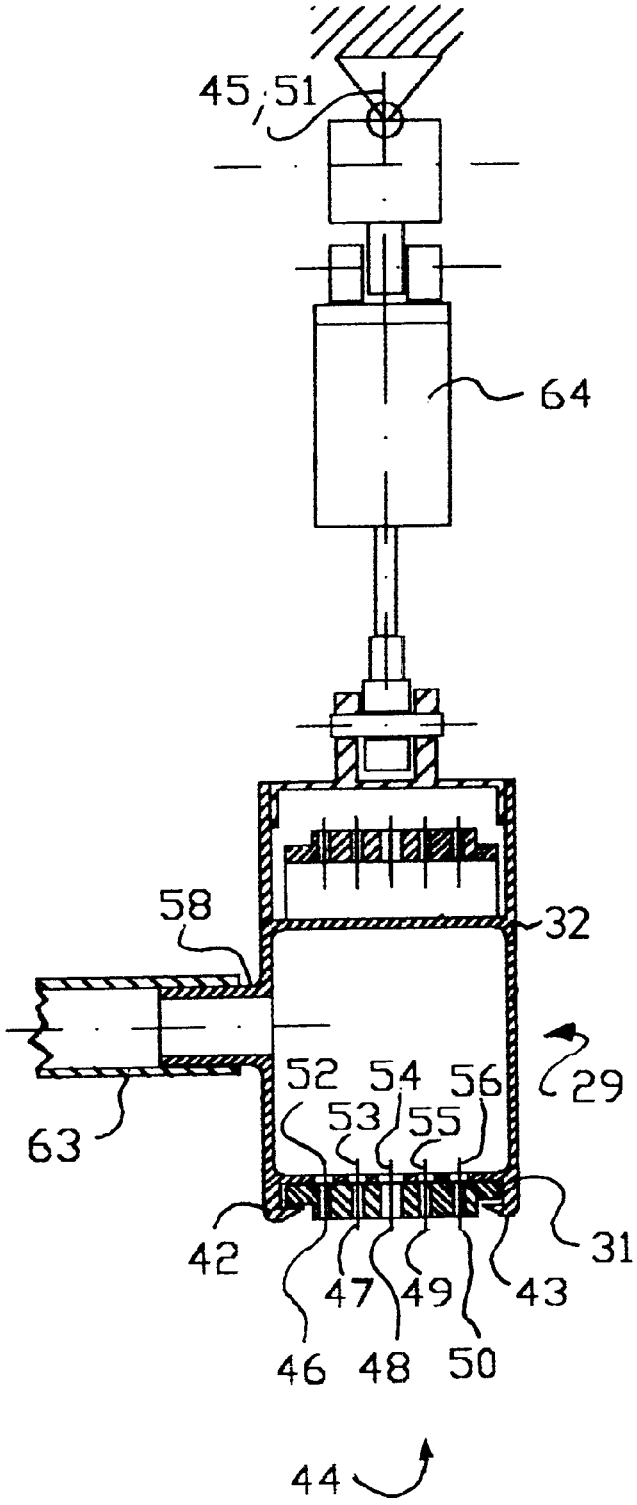

The following actions take place:

The clamped paper web 1, or the clamped partial web 16, each move along a movement track, for example A. By the application of a force through the devices 13, 21 to 24 for rerouting a web on their upper and/or undersides, the web 1 or the partial web 16 are pulled out of their original movement track, for example A, and are directed onto another movement track, for example movement track B, or movement track C. Because the device 21 to 24 for rerouting has a device 44 for holding and conveying of the web or the partial web, as seen in FIG. 2, the held web 1, or the partial webs 16 to 19 are therefore simultaneously moved along the former movement track, for example movement track A, and along the newly selected movement track, for example movement track C, and is or are accordingly separated at a predetermined breaking point or at a predetermined tear line formed by transverse perforations or by a water track made in the web 1, or partial webs 16 to 19 by the device 3. This occurs because the tear resistance is exceeded by the pulling force exerted on the web or the partial web at the predetermined transverse breaking point formed by the device 3. The affected web or the partial web is completely separated in such a way, that a "fresh" web end 5 and a "fresh" web start 15 are created. Together with its "fresh" web end 5, the web 1, or respectively the partial webs 16, 19, are pulled, for example, along their former movement track by drawing rollers, printing units, etc. The "fresh" web start 15 of the web 1, or of the partial webs 16 to 19, as well as the latter themselves, are held by the devices 21–24 for rerouting , are moved along the newly selected movement tracks, for example C, and are finally transferred to a forwarding system, for example 7, and are transported to an intended destination, such as, for example, a pair of drawing rollers, a print gap of a print unit, and taken over by them.

The shape of the predetermined breaking point or of the predetermined tear point can actually be designed in almost any arbitrary manner.

For example, the break or of tear point can be embodied as an acute-angled tip in the shape of a right triangle starting at one of the lateral edge, or also as a simple, non-oblique, i.e. straight tear.

The devices 13, or 21 to 24 for rerouting, which are suitable for rerouting, holding and conveying a web 1, or a partial web 16 to 19, for example can consist of a suction belt station, or of several suction belt stations 21 to 24, arranged next to each other and each centered over one partial web 16 to 19 of material to be printed. The suction belt stations 21 to 24 are each constructed the same. Only the suction belt station 21 shown in FIGS. 1 and 3 will be described in what follows.

The suction belt station 21 consists of several suction chambers 26, 27, 28, 29 which, viewed in the production direction E of the web, are arranged one behind the other. Each chamber 26, 27, 28, 29 is closed on five sides and has, for example, a trapezoidal cross section as seen in FIGS. 1 and 2. On their lower, wider bases 31, these chambers are flexibly connected with each other, for example by hinges. The narrow upper bases 32 are slightly convexly arched and have a plurality of holes. The narrow upper bases 32 are held apart adjustably by means of turnbuckles 33. Such an arrangement of the chambers 26 to 29 selectively makes a straight, a convexly curved, or a concavely curved suction track possible.

A start 34 and an end 36 of each suction belt station 21 has, viewed in the production direction E, a holder 37, 38, which is connected with its respective chamber 26, 29 and which supports a front belt roller 39, or a rear belt roller 41, respectively. All cylinders, rollers, and the like are seated in lateral frames 45, 50, as seen in FIG. 3 the same as the holder 37.

On their lower, wider bases 31, the chambers 26 to 29 have, viewed in the production direction E, guides 42, 43 on the left and right, respectively for a revolving suction belt 44. The suction belt 44 has spaced apart holes 46, 47, 48, 49, 50 over its entire length and width, which intermittently and alternatingly overlap holes 52, 53, 54, 55, 56 made in the lower, wide base 31 of the chambers 26 to 29, all as seen in FIG. 2.

The suction belt 44 is guided over both belt rollers 39, 41. The belt roller 39 is driven, for example, in such a way that on its side close to the web, the suction belt 44 travels at the speed of the press and in the production direction E. This drive is provided, for example, via toothed belts from the device 3 for reducing tear resistance, for example by means of an rpm-controllable electric motor.

Each chamber 26 to 29 has a connector 58 on its side, to which air lines 60, 61, 62, 63 respectively are connected. These air lines can be selectively connected with a suction air source or with a compressed air source. In this way, a plurality of chambers 26, 27, 28 can be charged with suction air, and at least the last chamber 29 can be changed with compressed air.

The delivery end 36 of the suction belt station 21 can be adjusted in height, for example by means of a work cylinder 64 which, at one end, is fixed in place on the suction belt station, and whose opposite support 45 is seated on a cross bar 51, which is fixed in place on the lateral frame.

In accordance with another preferred embodiment, the device 13 for rerouting, having a device for holding and conveying, can also be designed as a rotatable suction roller 13 air is provided to it via a rotating connector, not represented. In this case, it is possible to charge either the entire width of the suction roller 13 corresponding to the width of the web 1 of material to be printed, or to charge only one of several portions of the width of suction roller 13, corresponding to the width of a partial web or webs 16, 17, 18 or 19, with suction air. Approximately 270° of the interior circumference of the suction roller 13 is covered with a sealing coat 20, so that the suction only becomes effective at the circumference of the suction roller 13 against which the web 1 or the corresponding partial web or webs 16, 17, 18 or 19 is resting and at an amount of an angle β of approximately 90°. From a vertex line 71 on the surface of suction roller 13, which is a line where a change in the movement direction of the web 16 from one direction—for example a horizontal direction—into another direction—for example a vertical direction—takes place, the web 1 or the partial web 16 tears transversely along a predetermined cutting or tear line 68. The fresh web end part 5 of the partial web 16 continues to run over the paper guide rollers 9, 11 in the movement track B. The torn off part of the partial web with the fresh web start 15 continues to run along the movement track A and possibly from there onto another movement track, for example movement track C. In the process, the "fresh" start 15 of the partial web 16 is still aspirated in the area of the next to the last chamber 28, and in the area of the last chamber 29 it is pushed away by means of compressed air, and in this way is brought between the upper and lower belts of a forwarding system 7 and from there onto a preselected movement track, for example movement track C.

The method for transversely separating and changing the direction of a moving web of material to be printed, for example a paper web 1, operates as follows: a full-width paper web 1 moving in the production direction E is longitudinally cut into four quarter-width partial paper webs 16 to 19 by means of the longitudinal cutting devices 2 and is guided by the paper guide rollers 9 onto a first movement track A. The for example, left partial web 16 is provided with a predetermined separation or tear line 68 or 69, as depicted in FIG. 3, for example in the form of a transverse perforation line or a transverse water track, at a predetermined angle±α, for example 0° to 60°, and preferably 45°, in respect to a lateral edge 66 or 67, or in respect to the partial paper web 16, by means of a device 3 for reducing the tear resistance of the web, for example the transverse perforation device 3. Following the separation of the web 1, or the partial web 16, in the manner discussed above, a "fresh" web end 5 and a trailing "fresh" web start 15 of the web 1, or of the partial web 16, is created.

It will be understood that+α a means that the angle a is in reference to the right lateral edge 67 of the partial web 16, and that−α means that the angle a is in reference to the left lateral edge 66 of the partial web 16.

The suction belt station 21 arranged above the partial web 16, for example at a short distance "d"=one millimeter, is charged with compressed and suction air. The first chambers 26 to 28 are charged with suction air, and at least the last chamber 29 is charged with compressed air. The web or the partial web is aspirated and is held against the suction belt 44.

The web 1 or the partial web 16 is to be rerouted from the movement track A onto the movement track C in the following discussion. The web 1 or the partial web 16 moving, for example, in the movement track A, has a speed which is equal to the circumferential speed of the suction belt 21. The suction belt 21 aspirates the partial web 16, which is to be rerouted, in such a way, that it does not slip, if possible, and attempts to move or to draw it onto the new, preselected movement track, for example the movement track C. This means that the partial web 16 is moved in the movement track A, as well as in the movement track C. Because of this, the tensile stress exerted on the partial web 16 increases until the artificially generated reduction of the tear resistance of the partial web 16, created by the device for reducing tear resistance 3, is exceeded and the partial web 16 is transversely separated along a preselected or predetermined break line or tear line 68 or 69. A part of the partial web 16 continues to run in the movement track A, and the torn off part is conveyed on in the movement track C.

After the termination of the transverse separation and direction changing process, the air supply is cut off and the suction air station 21 is removed by means of the work cylinder 64 from the vicinity of the paper web 1 or the partial web 16, i.e. the suction air station 21 is pivoted up.

It is also possible to transfer one or several other partial webs downward onto a different movement track. This can take place by displacing the chambers 26 to 29 and the suction belt stations 21 to 24 in respect to each other in such a way, that the suction belt stations 21 to 24, and thus the suction belts 44 now have a concave shape in place of a convex shape. Therefore, separation of the paper webs or partial paper webs takes place by holding them and changing their direction.

A device for the complete transverse separation of the paper web 1, or for all of the partial webs 16 to 19 can also be provided. For example, this device may consist of a cutter holder, which can be moved up and down and which has a cutter that works together with a counter cutter fixed in place on the frame. The paper web 1, 16 to 19 is stopped or moves slowly, and is then transversely cut. During this process, the paper web 1, 16 to 19 is held by suction belts 44 via chambers, as described above. Two suction belt systems 44 are provided, which can both be driven and which are arranged one after the other, viewed in the production direction. The cutter moves up and down between the two suction belt systems 44 and transversely cuts the paper web 1, or the partial paper webs 16 to 19. In the process, a fresh web end 5 and a fresh web start 15 are created. The fresh web end 5 is held by the front suction belt system 44 and is conveyed on. The fresh web start 15 is held by the rear suction belt system 44, as viewed in the production direction E, and is subsequently conveyed on.

While preferred embodiments of a device for drawing-in paper webs, and a method for its use in accordance with the present invention have been set forth fully and completely hereinabove, it will be apparent to one of skill in the art that a number of changes in, for example, the source of supply of the paper web or webs, the type of printing press used, and the like can be made without departing from the true spirit and scope of the present invention, which is accordingly to be limited only by the following claims.

What is claimed is:

1. A method for drawing in a partial paper web in a printing press including;

providing a plurality of laterally spaced partial paper webs;

providing a first movement path for said plurality of laterally spaced partial paper webs;

drawing in said plurality of laterally spaced partial paper webs next to each other in a production direction along said first movement path;

forming a line of separation in at least one of said plurality of partial paper webs, said line of separation extending transverse to said production direction;

providing a second movement path, different from said first movement path, for said plurality of laterally spaced partial paper webs;

moving said at least one of said plurality of partial paper webs with said formed line of separation before, in said production direction, said line of separation along said first movement path;

moving said at least one of said plurality of partial paper webs with said formed line of separation after, in said production direction, said line of separation along said second movement path;

separating said at least one of said plurality of partial paper webs in a direction transverse to said production direction along said line of separation in response to said movement of said at least one of said plurality of partial paper webs along both said first movement path and said second movement path;

forming a fresh partial paper web start in said at least one of said plurality of partial paper webs at said now separated line of separation; and moving said at least one of said plurality of partial paper webs following said fresh partial paper web start along said second movement path different from said first movement path.

2. A method for guiding a paper web including:

providing a paper web;

providing an original movement track for said paper web;

drawing said paper web along said original movement track in a production direction;

forming a line of weakening in said paper web in a direction transverse to said production direction;

reducing the tear resistance of said paper web at said line of weakening;

providing a new movement track for said paper web, said new movement track being different from said original movement track;

guiding said paper web with said line of weakening, after, in said production direction, said line of weakening, onto said new movement track, different from said original movement track, by applying a force to one of an upper and a bottom surface of said paper web after, in said production direction, said line of weakening;

transversely separating said paper web, whose tear resistance has been reduced at said line of weakening, in response to said guiding of said paper web, after said line of weakening, to said new movement track;

forming a fresh end of said paper web and a fresh start of said paper web which has been transversely separated at said line of weakening;

moving said fresh start of said paper web along said new movement track; and moving said fresh end of said paper web along said original movement track.

3. A method for guiding a paper web including:

providing a paper web;

providing a first movement direction for said paper web;

moving said paper web along said first movement direction;

weakening the tear resistance of said paper web along a tear line extending at an angle with respect to said first movement direction across said paper web;

providing a second movement direction for said paper web different from said first movement direction;

rerouting said paper web, after said tear line, into said second movement direction;

moving said paper web, after said tear line, along said second movement direction; and separating said weakened tear resistant paper web at said tear line in response to said rerouting of said paper web, after said tear line, from said first movement direction to said second movement direction.

4. The method of claim 3 wherein said angle is in a range of 30° to 60°.

5. A device for drawing in paper webs into a web-fed rotary printing press comprising:

a first paper web movement path extending in a production direction;

a paper web tear resistance reducing device in said first movement path and transverse to said production direction and adapted to form a line of weakening in a paper web passing through said paper web tear resistance reducing device;

a second paper web movement path different from said first paper web movement path and extending in said production direction;

a suction station in said second paper web movement path, and after, in said production direction, said paper web tear resistance reducing device, said suction station having a plurality of suction sections; and means providing suction air to each of said plurality of suction sections, said suction sections each being adapted to draw a paper web to said suction station and to separate a paper web at a line of weakening in response to movement of a paper web with a line of weakening along both said first paper web movement path and said second, different paper web movement path.

6. The device of claim 5 wherein said first and second movement paths are on separate levels.

7. The device of claim 5 wherein said suction station includes a suction belt.

8. The device of claim 5 wherein said suction station has first and second ends and further wherein one of said first and second ends is height adjustable.

9. The device of claim 5 wherein each of said suction sections includes several chambers which are arranged one behind another in said production direction.

10. The device of claim 9 further wherein said plurality of suction sections each further includes a plurality of suction holes.

11. The device of claim 9 wherein said suction belt has a plurality of belt holes.

12. The device of claim 11 further wherein said plurality of suction sections further include a plurality of section holes.

13. The device of claim 9 further including means hingedly connecting said several chambers together to define a shapeable conveying track.

14. The device of claim 9 further including a source of air under pressure and further including means to selectively connect each of said chambers to said source of air under pressure.

15. The device of claim 9 further including means hingedly connecting said chamber together to define a shapeable conveying track adjacent to said paper webs.

16. The device of claim 7 further including an rpm-adjustable electric motor useable to drive said suction belt.

17. The device of claim 5 wherein said paper web tear resistance reducing device is a transverse cutting device, and further including a clock control for said transverse cutting device.

18. The device of claim 17 wherein said transverse cutting device includes a cutter, said cutter having a movement path between adjacent ones of said suction sections arranged in said direction of web travel.

* * * * *